US006157798A

United States Patent [19]

Kawanishi et al.

[11] Patent Number: 6,157,798

[45] Date of Patent: Dec. 5, 2000

[54] ELECTROSTATIC RECORDING APPARATUS

[75] Inventors: Tsuneaki Kawanishi; Tomonari Hokkyo; Katsuya Kawai; Koji Kato; Masayasu Anzai, all of Ibaraki, Japan

[73] Assignee: Hitachi Koki Co., Ltd., Tokyo, Japan

[21] Appl. No.: 09/285,651

[22] Filed: Apr. 5, 1999

[30] Foreign Application Priority Data

Apr. 3, 1998 [JP] Japan ..... 10-091624

[51] Int. Cl.[7] ..... G03G 15/00

[52] U.S. Cl. ..... 399/159; 430/110

[58] Field of Search ..... 399/159; 430/110

[56] References Cited

U.S. PATENT DOCUMENTS

| | | | |
|---|---|---|---|
| 4,933,244 | 6/1990 | Teuscher et al. | 430/58 |
| 5,438,398 | 8/1995 | Tanigawa et al. | 399/302 |
| 5,708,932 | 1/1998 | Yano et al. | 399/159 |
| 5,923,925 | 7/1999 | Nakamura et al. | 399/159 X |
| 5,942,361 | 8/1999 | Hoshizaki et al. | 399/159 X |
| 5,976,749 | 11/1999 | Sukata et al. | 430/110 |

FOREIGN PATENT DOCUMENTS 9-190125 7/1997 Japan .

*Primary Examiner*—William J. Royer
*Attorney, Agent, or Firm*—Sughrue, Mion, Zinn, Macpeak & Seas, PLLC

[57] ABSTRACT

An electrostatic recording apparatus including: an image carrier including an organic photoconductive photoreceptor having an abrasion-resisting outermost periphery; an exposing unit which exposes the image carrier to form an electrostatic latent image thereon; a developing unit which contains a toner and develops the electrostatic latent image with the toner to form a toner image; a transferring unit which transfers the toner image thus formed onto a recording medium; and a fixing unit which fixes the transferred toner image on said recording medium, wherein the toner contained in said developing unit includes an electrically conductive fine powder attached to the surface thereof.

9 Claims, 3 Drawing Sheets

ELECTROSTATIC RECORDING APPARATUS

FIELD OF THE INVENTION

The present invention relates to an electrostatic recording apparatus for repeatedly forming many duplicates of images such as electrophotographic apparatus. More particularly, the present invention relates to an electrostatic recording apparatus comprising an image carrier which comprises an organic photoconductive photoreceptor having an abrasion-resisting outermost periphery.

BACKGROUND OF THE INVENTION

Among various printing or recording processes, electrophotographic process comprises charging a photoconductive photoreceptor, imagewise exposing the photoconductive photoreceptor to light to form an electrostatic latent image thereon, developing the electrostatic latent image with a particulate toner comprising a coloring agent, etc., transferring the toner image onto a recording medium such as recording paper, and then fixing the toner image thus transferred.

In such an electrostatic image recording process, the surface of the photoreceptor from which the toner image has been transferred is freed of residual particulate toner and destaticized for possible subsequent prolonged repeated use. Accordingly, the foregoing photoreceptor needs to have resistance to inert gas produced during charging such as ozone and NOx (corona resistance), not to mention excellent electrophotographic properties. In particular, the photoreceptor must satisfy requirements for durability and abrasion resistance during repeated use.

In recent years, with the development of data apparatus, a laser beam printer has been developed which uses laser beam to expose the photoconductive photoreceptor to light so that a modified signal as indicated by computer is given to reproduce the recorded image in dot form. In particular, the recent trend is for laser beam printers to form images with even higher quality. Accordingly, the laser beam to be used in the recent laser beam printers is reduced in diameter to raise the resulting dot density to as high as from 600 dpi (dots/inch) to 1,200 dpi. With this trend, there has been a growing demand for enhancement of durability and abrasion resistance of photoreceptors for the purpose of retaining these fine electrostatic latent images.

As electrophotographic photoreceptors there have heretofore been often used inorganic photoconductive photoreceptors made of amorphous silicone, selenium or the like. In recent years, however, the trend is toward the use of organic photoconductive photoreceptors (hereinafter referred to as "organic photoreceptors"), which can be produced at less cost, give no toxicity and are sensitive to the wavelength range of exposing light, particularly to the long wavelength range such as semiconductor laser wavelength range, to be used.

The fatigue deterioration of the foregoing photoreceptor after repeated use is possibly attributed to abrasion and damage on the surface of the photoreceptor developed when it is rubbed at the step of separating and transferring the toner image formed thereon onto the recording medium and removing residual toner from the photoreceptor and denaturation and decomposition of the surface layer of the photoreceptor at the step of charging, exposure and destaticization of the surface of the photoreceptor.

Accordingly, in order to prevent the fatigue deterioration of the foregoing photoreceptor, it is important to improve the surface layer of the photoreceptor. In particular, organic photoreceptors are softer than inorganic photoreceptors and comprise an organic material as a photoconductive material and thus are liable to drastic fatigue deterioration after repeated use. Thus, the improvement of the surface layer is more important for these organic photoreceptors.

On the other hand, processes for developing electrostatic latent image with a toner can be roughly divided into two groups, i.e., binary development process using a binary developer comprising a toner and a carrier and unitary development process using a toner alone. Various proposals have been made for each of the two development processes. In particular, laser beam printers often use a binary developer comprising a toner and a carrier to satisfy the requirements for higher recording speed and higher image quality. The recent trend is for binary developers having a smaller particle diameter to be used. The application of a particulate toner having a volume-average particle diameter of not more than 10 $\mu$m and a particulate carrier having a weight-average particle diameter of not more than 100 $\mu$m has been under way.

In the electrostatic recording process, the step of fixing a toner image on the recording medium is important. Examples of toner image fixing processes which have heretofore been frequently used include heat roller fixing process having so high a thermal efficiency as to provide a high speed fixing and heat fixing process using a heat source such as oven and flash lamp. For the heat roller fixing process in particular, the development of a toner which can be fixed at a reduced power consumed for fixing heater and hence a lowered heat roller temperature has been desired to satisfy the following requirements:

(1) To inhibit overheat deterioration of printer and hence heat deterioration of parts thereinside;

(2) To shorten the warming-up time between the time at which the fixing device is actuated and the time at which fixing is made possible; and (3) To inhibit unthorough fixing due to absorption of heat by the recording paper, making it possible to form images on continuous paper.

The use of a finely particulate toner having a particle diameter of not more than 10 $\mu$m causes the following troubles. The use of a finely particulate toner in the development process can provide a high resolution and a high dot density reproducibility, making it possible to reduce the amount of the toner required to obtain the same image density. However, such a toner has an increased specific surface area that increases chargeability per unit weight of the toner, possibly causing deterioration of image density.

Further, individual toner particles each have a reduced surface area and hence a reduced chargeability. Thus, such a finely particulate toner is liable to attachment to non-image area (fog) and toner flying. Such a finely particulate toner exhibits a deteriorated fluidity that makes itself less handleable during transportation or other occasions.

Moreover, such a finely particulate toner exhibits high adhesion and a low impact resistance that can cause carrier stain (carrier spent) and hence reduction of the life of developer. Further, it is rather difficult to remove such a finely particulate toner from the photoreceptor, possibly causing the formation of thin film on the photoreceptor during printing (filming).

Further, such a finely particulate toner requires a greater energy to obtain the same fixing strength than a toner having a greater particulate diameter. Thus, the toner constituting the image can be partially transferred to the surface of the heat roller during fixing, possibly causing offset, i.e., phenomenon involving re-transfer of the toner thus transferred to subsequent recording paper and stain on the image formed thereon. Further, the production of such a finely particulate toner is liable to yield drop at grinding and classification steps that adds to production cost thereof. Thus, such a finely particulate toner is liable to these many troubles. In general, therefore, a toner having a particle diameter of less than 6 μm can be hardly put into practical use. In practice, toner particles are classified into a range of from 6 μm to 10 μm before use.

Nevertheless, even a particulate toner having a particle diameter falling within the above-defined range is liable to the foregoing various troubles. Attempts have been made to overcome these troubles and hence obtain a high precision image at a high reliability. Referring to chargeability for example, as the particle diameter of toner particles is reduced, individual particles each have a reduced chargeability that causes the foregoing troubles. Attempts have been made to secure desired chargeability by enhancing the dispersibility of pigment or charge controller constituting the toner as described in H. T. Macholdt, 1991 transactions of "Japan Hardcopy", page 13, 1991.

As disclosed in JP-B-8-3660 (The term "JP-B" as used herein means an "examine Japanese patent publication"), an attempt has been made to improve the low temperature fixability and offset resistance of toner by using as a binder an aromatic polyester resin comprising an amorphous polymer block and a crystalline polymer block in a proper proportion in its molecule.

Referring to carrier, the reduction of the particle diameter of toner is accompanied by the use of a carrier having a particle diameter as small as not more than 100 μm as calculated in terms of weight-average particle diameter and hence a raised specific surface area that improves the triboelectricity of the toner. However, such a carrier having a particle diameter of less than 40 μm exhibits a lowered magnetic force and thus can easily be electrostatically attracted to the image carrier. Thus, carrier particles are classified into a range of from 40 μm to 100 μm before use.

When the carrier particles fall within this range, the resulting developer has a small particle diameter itself. In the electrophotographic process, a proposal has been made that such a small particle diameter developer not only exhibit an improved chargeability but also enhance the capacity of recycling the toner recovered from the image carrier as disclosed in JP-A-8-15986. With these improvements, more finely particulate toners and developers have been put into practical use in copying machines, printers, etc.

However, when printing is repeated using a practical electrostatic recording apparatus, the foregoing problems characteristic to finely particulate toner, particularly increase in the chargeability of the toner caused by printing, can be hardly avoided, making it impossible to keep the image density to a proper range.

In order to control the chargeability of toner to a proper range, it is necessary to properly select the kind and amount of the charge controller to be incorporated in the toner. It is further important to attach a fluidizing agent to the surface of toner so that the fluidity of the toner is improved to unify the chargeability of the surface of the toner. As such a fluidizing agent there may be used a particulate inorganic material such as silica powder, alumina powder and titania powder or a particulate organic material such as acrylic resin powder and polyamide resin powder, most normally silica powder. However, the improvement of the fluidity of toner alone cannot stabilize the chargeability of the toner.

SUMMARY OF THE INVENTION

It is therefore an object of the present invention to provide an electrostatic recording apparatus which can repeatedly print on many sheets of printing paper without deteriorating image properties to give stabilized images.

Other objects and effects of the present invention will become more apparent from the following description.

The foregoing objects of the present invention have been achieved by providing the following electrostatic recording apparatuses.

1) An electrostatic recording apparatus comprising:

an image carrier comprising an organic photoconductive photoreceptor having an abrasion-resisting outermost periphery;

an exposing unit which exposes said image carrier to form an electrostatic latent image thereon;

a developing unit which contains a toner and develops said electrostatic latent image with said toner to form a toner image;

a transferring unit which transfers the toner image thus formed onto a recording medium; and a fixing unit which fixes the transferred toner image on said recording medium, wherein said toner contained in said developing unit comprises an electrically conductive fine powder attached to the surface thereof.

2) An electrostatic recording apparatus comprising:

an image carrier comprising an organic photoconductive photoreceptor having an abrasion-resisting outermost periphery;

an exposing means for forming an electrostatic latent image on said image carrier;

a developing means for developing said electrostatic latent image with a toner to form a toner image;

a transferring means for transferring the toner image thus formed onto a recording medium; and a fixing means for fixing the transferred toner image on said recording medium, wherein said toner used in said developing means comprises an electrically conductive fine powder attached to the surface thereof.

3) The electrostatic recording apparatus according to the above 1), wherein said electrically conductive fine powder is at least one inorganic powder selected from the group consisting of magnetic powder, tin oxide powder and powder of indium oxide having tin incorporated therein.

4) The electrostatic recording apparatus according to the above 1), wherein said toner comprises a fluidizing agent attached to the surface thereof.

5) The electrostatic recording apparatus according to the above 1), wherein said organic photoreceptor comprises:

an electrically conductive substrate;

a charge-generating layer; and a charge-transporting layer comprising at least an outer surface side charge-transporting layer and an electrically conductive substrate side charge-transporting layer, wherein said outer surface side charge-transporting layer has a concentration of charge-transporting material which is smaller than that of said electrically conductive substrate side charge-transporting layer.

6) The electrostatic recording apparatus according to the above 1), wherein said organic photoreceptor comprises a charge-transporting layer comprising a plurality of layers including at least an outer surface side charge-transporting layer, wherein said outer surface side charge-transporting layer contains an organic or inorganic fine powder.

7) The electrostatic recording apparatus according to the above 1), wherein said developing unit comprises:

a first developing unit containing a color toner; and a second developing unit containing a black toner, wherein said color toner comprises a white or transparent electrically conductive fine powder attached to the surface thereof, and said black toner comprises a black electrically conductive fine powder attached to the surface thereof.

8) The electrostatic recording apparatus according to the above 2), wherein said developing means comprises:

a first developing means for developing said electrostatic latent image with a color toner; and a second developing means for developing said electrostatic latent image with a black toner, wherein said color toner comprises a white or transparent electrically conductive fine powder attached to the surface thereof, and said black toner comprises a black electrically conductive fine powder attached to the surface thereof.

BRIEF DESCRIPTION OF THE DRAWINGS

By way of example and to make the description more clear, reference is made to the accompanying drawings in which.

DETAILED DESCRIPTION OF THE INVENTION

Figure 1:
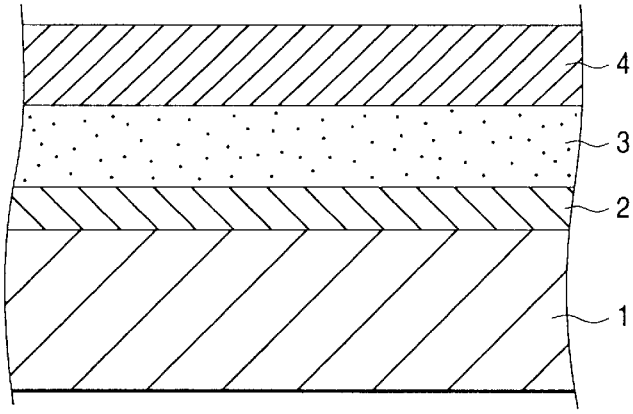
FIG. 1 is a partly enlarged sectional view of an N-OPC.

As described above, a finely particulate toner having a volume-average particle diameter of from 6 μm to 10 μm has a raised specific surface area and hence a raised chargeability per unit weight thereof that deteriorates the developability thereof. Thus, the use of such a finely particulate toner often causes deterioration of image density. An examination was made on the change of the density of image, under some printing conditions, which is obtained by a process which comprises developing an electrostatic latent image formed on a normal-type organic photoconductor (hereinafter referred to as "N-OPC") comprising an undercoat 2, a charge-generating layer 3 and a charge-transporting layer 4 sequentially laminated on an electrically conductive substrate 1 as shown in FIG. 1 by a reverse development process (development process involving the attachment of a toner having the same polarity as that of electrostatic latent image to the area free of charge), transferring the resulting toner image onto the recording paper, fixing the toner image, and then removing the residual toner from OPC with a blade cleaner in a laser beam printer utilizing an electrostatic recording process, particularly electrophotographic process, using such a finely particulate toner. The results are shown in FIG. 2.

Figure 2:
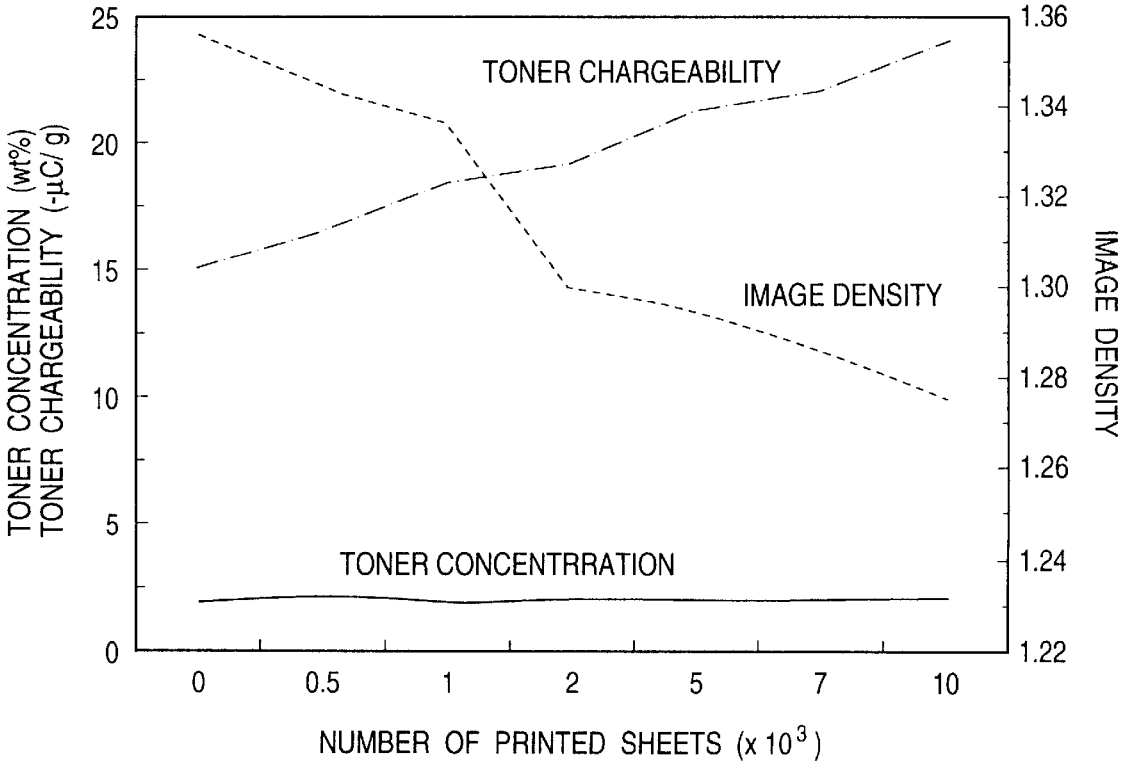
FIG. 2 is a characteristic curve illustrating the change in toner concentration, toner chargeability and image density during continuous printing with developer A.

In FIG. 2, the numbers on the abscissa indicate the number of printed sheets (unit: 1,000 pages) while the numbers on the left ordinate indicate the chargeability of toner and the toner density and the numbers on the right ordinate indicate the image density. The one-dot-and-dash line indicates the characteristic curve illustrating the change in the chargeability of toner, the solid line indicates the characteristic curve illustrating the toner density and the dotted line indicates the characteristic curve illustrating the change in the image density.

In this test, the concentration of charge-transporting agent in the charge-transporting layer 4 of N-OPC was 45% by weight. As a developer there was used a developer comprising a styrene-acryl-based negative-working toner having a volume-average particle diameter of 9 μm, a glass transition point of 62° C. and a softening point of 125° C. and a silicone resin-coated magnetite-based carrier containing an electrically-conducting agent having a weight-average particle diameter of 95 μm. The toner comprised a hydrophobic silica (Aerosil R-972, produced by Nippon Aerosil Co., Ltd.) attached to the surface thereof in an amount of 0.3% by weight based on the weight thereof. This developer is hereinafter referred to as "developer A".

The toner development was effected at an N-OPC charge potential of −750 V, a residual potential of −50 V, a development bias potential of −450 V and a development portion contrast potential of 400 V. Under these conditions, reversal development was effected at a printing speed of 60 sheets per minute (printing process speed: 27 cm/sec). The toner density in the developer (mixing proportion of toner with respect to developer) was initially 2.0% by weight. Continuous printing was effected over 10,000 pages.

For the measurement of toner chargeability, so-called "suction Faraday process" (described in JP-A-7-261553 and Toru Miyasaka et al., 1996 transactions of "Japan Hardcopy", page 97, 1996) which comprises suction-separating a toner from a carrier under a negative pressure (about 0.26 kgf/cm$^2$) whereby the charge stored in the carrier having the polarity opposite to that of the toner is measured by means of a Faraday cage. The toner chargeability and concentration in the developer sampled from the development portion of the developing machine were measured.

As can be seen in FIG. 2, as the number of printed sheets increases, the image density decreases. The image density of not less than 1.3, which is normally considered desirable, can be obtained over the initial 2,000 pages. As continuous printing proceeds, the toner chargeability increases. The drop of image density occurring when the number of printed sheets goes beyond 2,000 pages is presumably attributed to the increase in the toner chargeability.

On the other hand, the foregoing toner was mixed with a fine magnetic powder (Type KBC-100S cubic magnetite produced by KANTO DENKA KOGYO CO., LTD.; average particle diameter: 0.25 μm) as an electrically-conducting agent in as amount of 0.5% by weight based on the weight thereof so that the fine magnetic powder was attached to the surface of the toner. The toner was then mixed with the same carrier as above to prepare a developer B. Continuous printing was then effected with the developer B over 10,000 pages under the same image forming conditions as above.

Figure 3:
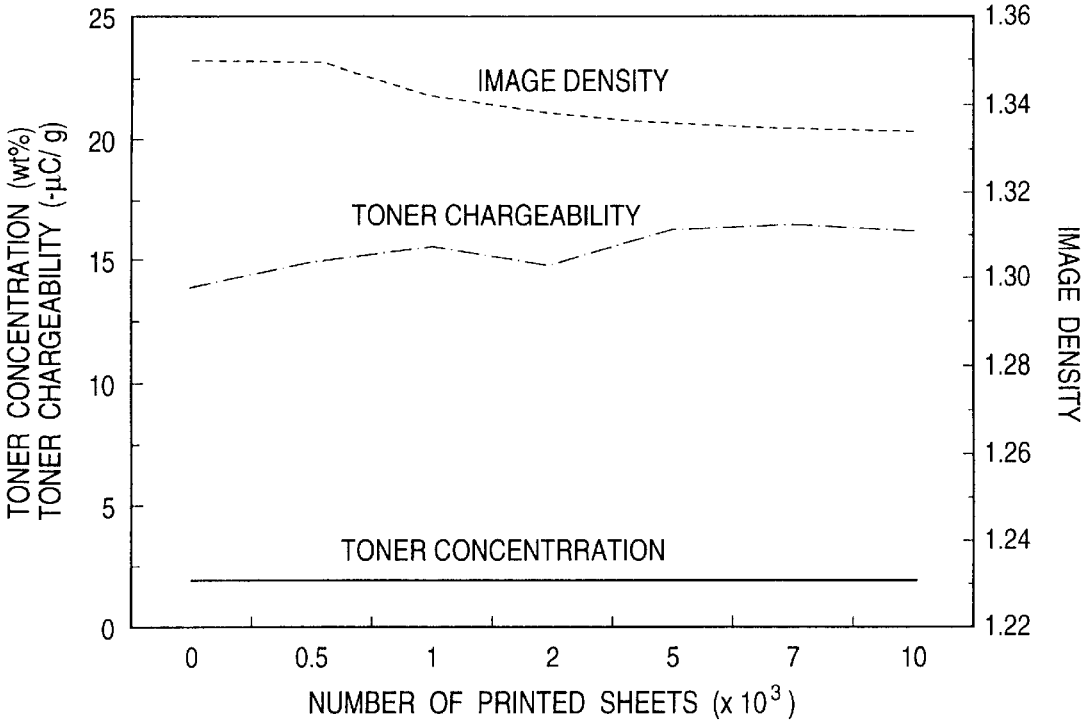
FIG. 3 is a characteristic curve illustrating the change in toner concentration, toner chargeability and image density during continuous printing with developer B.

The results are shown in FIG. 3. As can be seen in the results, the image density shows no drop even with the increase in the number of printed sheets, making it possible to keep the image density of not less than 1.3, which is normally considered desirable. Further, the change in the toner chargeability shows that the toner chargeability increases little even with continuous printing.

The foregoing phenomenon can be interpreted as follows. In some detail, when the developer A is used, a toner having a proper chargeability is selectively developed to obtain an image density of not less than a predetermined value. However, as the number of printed sheets increases, a toner having a poor developability and an unsuitable chargeability (too great or small a chargeability) is accumulated on the surface of carrier to reduce the bulk specific gravity of the developer (proportion of the carrier per unit volume).

Thus, an ordinary permeability detection process toner concentration controller judges that the toner exists in a sufficient amount to inhibit the supply of the toner. Accordingly, the amount of the toner decreases, and the chargeability further increases. At the same time, the coat layer on the carrier undergoes abrasion and peeling, deteriorating the capacity of controlling the toner chargeability. Thus, the chargeability increases, making it difficult for the toner to be liberated from the surface of the carrier. Accordingly, the bulk specific gravity of the developer decreases. As this vicious circle continues, the toner chargeability further increases due to friction with the carrier, decreasing the toner concentration and hence lowering the image density to not more than the allowable limit.

On the contrary, the developer B comprises an electrically conductive particulate material attached to the surface of a toner, making it possible for the toner to be charged quickly and hence optimize the charged amount. Thus, the foregoing difficulties in development can hardly occur. Accordingly, the image density is stabilized.

Examples of the electrically conductive particulate material to be attached to the surface of the toner in the present invention include the following materials:

(i) Magnetic powder ($Fe_3O_4$) (Resistivity: $10^4$–$10^9$ Ω-cm)

(ii) Tin oxide ($SnO_2$) (Resistivity; $10^2$–$10^4$ Ω-cm)

(iii) ITO having a proper amount of tin (tetravalent) incorporated in indium oxide ($In_2O_3$)

Using the foregoing developer B, continuous printing was effected over 300,000 pages. As a result, the developer showed little change in the toner chargeability and toner concentration. However, image defects, particularly image background stain (fog), occurred more as printing proceeded. The reason for this phenomenon was examined. This phenomenon is presumably attributed to the drop of surface potential due to abrasion of N-OPC during continuous printing. The results of examination of abrasion of N-OPC are shown by the solid line in FIG. 4.

Figure 4:
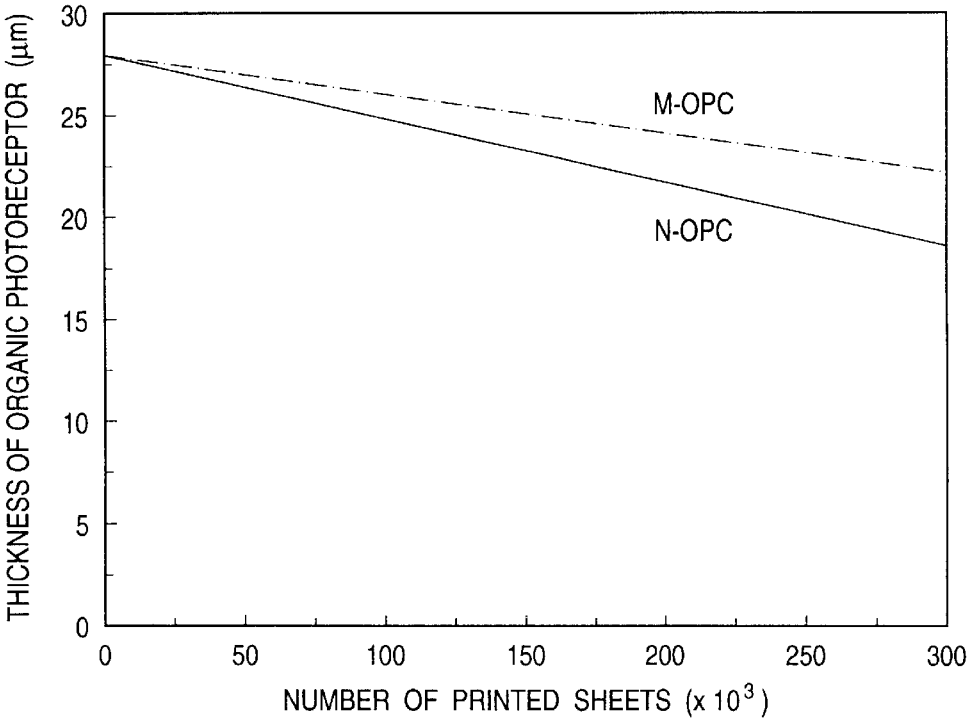
FIG. 4 is a diagram illustrating the change in the thickness of an organic photoreceptor during continuous printing.

In FIG. 4, the numbers on the abscissa indicate the number of printed sheets and the numbers on the ordinate indicate the thickness of the organic photoreceptor. As can be seen in this graph, the thickness of N-OPC, which was initially 28 μm, was reduced to 18.4 μm due to abrasion after continuous printing over 300,000 pages. At the same time, N-OPC showed a charged potential drop of from 100 V to 150 V. Thus, the resulting image was fogged. In order to prevent the deterioration of image properties with continuous printing, the following countermeasure was taken.

This countermeasure involves the application of the developer B, which comprises a fluidizing agent and a magnetic powder attached to the surface of a toner to exhibit stabilized chargeability and image properties, to a multilayer type organic photoconductor (hereinafter referred to as "M-OPC") comprising at least a charge-generating layer and a plurality of charge-transporting layers laminated on an electrically conductive substrate. In this arrangement, M-OPC exerts an effect of reducing abrasion, making it possible to stabilize the image properties even when the developer B, which exhibits high grinding properties, is used.

Specific examples of the structure of M-OPC is given below.

(1) OPC comprising two charge-transporting layers which are formed via an interlayer containing a thermosetting resin and a charge-transporting agent, in which the concentration of the charge-transporting agent in the charge-transporting layer close to the charge-generating layer is predetermined as high as 20% to 83% while the concentration of the charge-transporting agent in the charge-transporting layer close to the outer surface side (the "outer surface side" used herein means the side opposite to the electrically conductive substrate side in the photoreceptor) is predetermined as low as 10% to 20% whereby the corona resistance thereof is improved;

(2) OPC comprising two or more charge-transporting layers in which at least the charge-transporting layer on the outer surface side contains a polycarbonate resin having a viscosity-average molecular weight of not less than $4.0\times10^4$ and a particulate organic or inorganic material and has a smaller charge-transporting agent concentration than the charge-transporting layer on the substrate side whereby the surface hardness thereof is enhanced;

(3) OPC comprising at least two charge-transporting layers in which the charge-transporting layer on the electrically conductive substrate side comprises a charge-transporting agent having a specific structure excellent in sensitivity, potential stability and residual potential; and (4) OPC comprising at least two charge-transporting layers in which the outermost charge-transporting layer comprises a silicon-containing polycarbonate resin incorporated therein so that the abrasion resistance thereof is improved.

Figure 5:
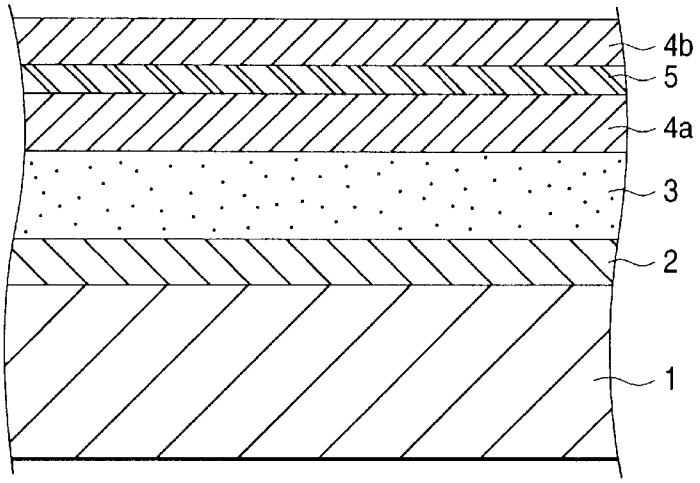
FIG. 5 is a partly enlarged sectional view of another N-OPC.

As shown in FIG. 5, OPC having the foregoing structure (1) comprises a charge-generating layer 3 formed on an electrically conductive substrate 1 with an undercoat layer 2 provided interposed therebetween. Sequentially formed on the charge-generating layer 3 are a first charge-transporting layer 4*a*, an interlayer 5 and a second charge-transporting layer 4*b*. The first charge-transporting layer 4*a* and second charge-transporting layer 4*b* each comprise a charge-transporting agent and a thermosetting resin incorporated therein wherein the concentration of the charge-transporting agent in the first charge-transporting layer 4*a*, which is close to the charge-generating layer 3, is predetermined as high as 20% to 83% while the concentration of the charge-transporting agent in the second charge-transporting layer 4*b*, which is close to the outer surface, is predetermined as low as 10% to 20%. The interlayer 5 is composed of a charge-transporting agent and a thermosetting resin.

As the electrically conductive substrate for use in the present invention there may be used a metal such as aluminum, aluminum alloy, steel, iron and copper or an electrically conductive plastic.

Examples of the charge-generating agent for use in the present invention include phthalocyanines such as metal phthalocyanine and metal-free phthalocyanine, anthraquinones, indigoids, quinacridones, perylenes, polycyclic quinones, and squaric acid methines. These charge-generating agents may be used singly or in admixture.

Examples of the charge-transporting agent for use in the present invention include oxadiazole, triazole, imidazolone, oxazole, pyrazoline, imidazole, imidazolidine, benzothiazole, benzoxazole, triphenylamine, and derivatives thereof. These charge-transporting agents may be used singly or in admixture.

As a binder constituting the foregoing charge-generating layer, charge-transporting layer and interlayer there may be used a silicone resin, phenolic resin, urea resin, melamine resin, furan resin, epoxy resin, silicone resin, vinyl chloride-vinyl acetate copolymer resin, urethane resin, vinyl acetate-methacryl copolymer resin, acrylic resin, polycarbonate resin, polyester resin, polyacrylate resin or the like.

OPC having the foregoing constitution (2) comprises two or more charge-transporting layers. The charge-transporting layer on the electrically conductive substrate side preferably comprises a charge-transporting agent having the following general structural formula (1), (2) or (3) and the charge-transporting layer on the outer surface side comprises a charge-transporting agent having the following general structural formula (1).

(1)

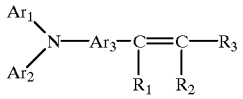

wherein $Ar_1$ and $Ar_2$ each represents an alkyl group or aryl group; $Ar_3$ represents a phenylene group; one of $Ar_1$ and $Ar_2$ may be connected to $Ar_3$ to form a cycle containing nitrogen; $R_1$, $R_2$ and $R_3$ each represents a hydrogen atom, alkyl group or aryl group; and $R_2$ and $R_3$ may be connected to each other to form a cycle.

(2)

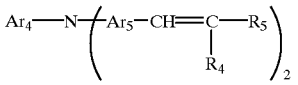

wherein $Ar_4$ represents an alkyl group or aryl group; $Ar_5$ represents a phenylene group; and $R_4$ and $R_5$ each represents a hydrogen atom, alkyl group or aryl group and may be connected to each other to form a cycle.

(3)

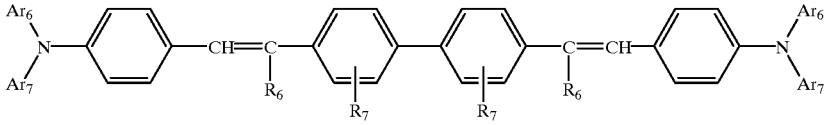

wherein $Ar_6$ and $Ar_7$ each represents an alkyl group or aryl group; one of $Ar_6$ and $Ar_7$ and the phenylene group connected to nitrogen group may be connected to each other to form a cycle; $R_6$ represents a hydrogen atom, alkyl group or aryl group; and $R_7$ represents a hydrogen atom, alkyl group, alkoxy group or halogen atom.

Examples of the particulate organic material to be incorporated in the charge-transporting layer on the outer surface side include particulate silicone resin, particulate fluororesin, particulate melamine resin, particulate polyolefin resin, and particulate acrylic resin.

OPC having the foregoing constitution (3) comprises two or more charge-transporting layers. The charge-transporting layer on the electrically conductive substrate side preferably comprises a charge-transporting agent having the following general structural formula (4) or (5) and the charge-transporting layer on the outer surface side preferably comprises a charge-transporting agent having the following general structural formula (6).

(4)

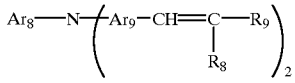

wherein $Ar_8$ represents a substituted or unsubstituted alkyl or aryl group; $Ar_9$ represents a phenylene group; and $R_8$ and $R_9$ each represents a hydrogen atom or substituted or unsubstituted alkyl or aryl group and may be connected to each other to form a cycle.

(5)

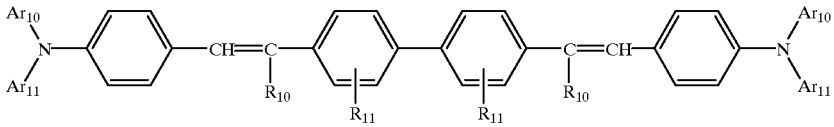

wherein $Ar_{10}$ and $Ar_{11}$ each represents a substituted or unsubstituted alkyl or aryl group; $R_{10}$ represents a hydrogen atom or substituted or unsubstituted alkyl or aryl group; and $R_{11}$ represents a hydrogen atom, alkyl group, alkoxy group or halogen atom.

(6)

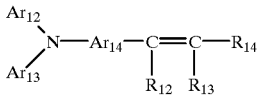

wherein $Ar_{12}$ and $Ar_{13}$ each represents a substituted or unsubstituted alkyl or aryl group; $Ar_{14}$ represents a phenylene group; and $R_{12}$, $R_{13}$ and $R_{14}$ each represents a hydrogen atom or substituted or unsubstituted alkyl or aryl group.

In the present invention, these M-OPS's may be appropriately selected. In particular, by arranging the foregoing plurality of charge-transporting layers such that the concentration of charge-transporting agent in the constituent layer on the outer surface side is smaller than that of the constituent layer on the electrically conductive substrate to the maximum as required, OPC having improved abrasion resistance and corona resistance can be obtained, making it possible to form a stabilized image.

Using M-OPC of the foregoing type comprising a charge-transporting layer consisting of two layers wherein the constituent layer on the outer surface side has a charge-transporting agent concentration of 20% by weight and a thickness of 10 μm while the constituent layer on the electrically conductive substrate side has a charge-transporting agent concentration of 50% by weight and a thickness of 18 μm, continuous printing was effected with the foregoing developer B over 300,000 pages. The results of abrasion resistance of M-OPC are shown by the one-dot-and-dash line in FIG. 4.

The results show that although M-OPC showed a drop of thickness, which had been initially 28 μm, to 22 μm due to abrasion by 300,000 page continuous printing and a charge potential drop of from about 50 V to 100 V, the resulting image showed no fog and hence a good quality to the end of pages because the drop of charge potential is relatively small. The foregoing printing test also showed that even with a toner comprising a magnetic powder having high grinding properties incorporated therein, M-OPC can operate over a printing life of not less than 100,000 pages longer than N-OPC, making it possible to reduce the cost of expendables required per sheet of printing paper.

Upon carry out the present invention, as the toner binder there may be normally used a styrene resin or polyester resin, if fixed on the foregoing heat roller, or a polyester resin or epoxy resin, if fixed in oven or by flash lamp. If low temperature fixing is desired as in the present invention, a polyester resin or epoxy resin can be effectively used to provide desired low temperature fixability while keeping the toner resistant to blocking and fluid because these resins exhibit a high glass transition point, making it possible to predetermine the softening point of the toner low. There are many kinds of polyester resins. As the polyester resin for toner there may be effectively used a polyester resin partially having a crosslinking component for enhancing offset resistance during heat roller fixing.

On the other hand, as the polyester for toner to be fixed in oven or by flash lamp there may be effectively used a polyester resin free of crosslinking component. As the foregoing polyester resin partially having a crosslinking component there may be used one synthesized from the following monomers. Examples of trifunctional or higher polyfunctional monomers constituting the crosslinking component include polyvalent alcohol monomers such as sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxymethylbenzene.

Examples of polyvalent carboxylic monomers as the foregoing polyfunctional monomers include 1,2,4-benzene tricarboxylic acid, 1,2,5-benzenetricarboxylic acid, 1,2,4-cyclohexanetricarboxylic acid, 2,5,7-naphthalene tricarboxylic acid, 1,2,4-butanetricarboxylic acid, 1,2,5-hexanetricarboxylic acid, 1,3-dicarboxy-2-methylcarboxy propene, 1,3-dicarboxy-2-methyl-2-methylenecarboxy propane, tetra(methylenecarboxy)methane, 1,2,7,8-octane tetracarboxylic acid, enpole trimer acid, and anhydrides thereof.

Examples of divalent alcohol monomers constituting the basic skeleton of polyester resin include diols such as ethylene glycol, diethylene glycol, triethylene glycol, 1,2-propylene glycol, 1,3-propylene glycol, 1,4-butanediol, neopentyl glycol and 1,4-butenediol, bisphenol A, etherified bisphenol A compounds such as hydrogenated bisphenol A, polyoxyethylenated bisphenol A and polyoxypropylenated bisphenol A, and other divalent alcohol monomers.

Examples of divalent carboxylic monomers as the foregoing polyfunctional monomers include maleic acid, fumaric acid, mesaconic acid, citraconic acid, glutaconic acid, phthalic acid, isophthalic acid, terephthalic acid, cyclohexanedicarboxylic acid, succinic acid, adipic acid, sebasic acid, malonic acid, anhydrides thereof, dimers of lower alkyl ester with linolenic acid, and other divalent organic acid monomers.

These alcohols and acids may be subjected to dehydropolycondensation to synthesize a partially-crosslinked polyester resin. Further, the dehydropolycondensation of a divalent alcohol and a divalent acid alone makes it possible to synthesize a polyester resin free of crosslinking component. However, a polyester resin contains much unreacted hydroxyl group or carboxyl group at the end of molecule or in main chain and thus can easily adsorb moisture. The resulting toner is liable to change in electrical properties, particularly chargeability, with environmental conditions.

In an attempt to improve environmental resistance, an approach has been proposed involving the graft copolymerization of a polyester resin with a styrene acrylate resin having a polar group reactive with the hydroxyl group or carboxyl group in the polyester resin. Such a styrene acrylate-modified polyester resin, too, may be preferably used in the present invention. The content of a trifunctional or higher polyfunctional monomer component in these polyester resins is preferably from 1 to 30 mol %. If the content of polyfunctional monomer component falls below the above-defined range, offset occurs during heat roller fixing. On the contrary, if the content of polyfunctional monomer component exceeds the above-defined range, the resulting toner exhibits deteriorated fixability.

The foregoing toner comprising a styrene resin, polyester resin, epoxy resin or styrene acrylate-modified polyester resin preferably has a glass transition point of from 50° C. to 70° C. The toner having a glass transition point of lower than 50° C. exhibits deteriorated fluidity, grindability, blocking resistance, filming resistance and durability. On the other hand, the toner having a glass transition point of higher than 70° C. exhibits a deteriorated low temperature fixability. Further, the softening point of the toner is preferably from 90° C. to 140° C. The toner having a softening point of lower than 90° C. exhibits deteriorated fluidity, offset resistance, grindability, blocking resistance, filming resistance and durability. On the other hand, the toner having a glass transition point of higher than 140° C. exhibits a deteriorated low temperature fixability.

The glass transition point and softening point of the toner according to the present invention can be measured in the following manner. For the measurement of glass transition point, differential scanning calorimetry (DSC) is employed. In some detail, about 10 mg of the toner is heated from room temperature to about 150° C. in an atmosphere of nitrogen at a constant rate of 10° C./min. The glass transition point is determined from the point of intersection of the base line and the inclination of the heat absorption peak.

For the measurement of softening point, a flow tester (the Koka type flow tester) is employed. About 1 g of the specimen is previously heated to a temperature of 80° C. for several minutes, and then heated at a rate of 6° C./min under a load of from 20 kgf/cm$^2$ to 30 kgf/cm$^2$ with a nozzle having a diameter of 1 mm and a length of 1 mm. The temperature (½ flow temperature) corresponding to half the height of S curve in the tester plunger fall-temperature curve (softening flow curve) is defined as softening point.

The toner comprising such a styrene resin, polyester resin, epoxy resin or styrene acrylate-modified polyester resin having the foregoing melt properties can be fixed at low temperatures in particulate form, which is aimed at in the present invention.

The present invention has been described with reference to a non-magnetic binary negative-working toner and developer in particular. It was found that the present invention can apply to a non-magnetic binary positive-working toner and developer, a non-magnetic unitary positive-working toner or negative-working toner, a magnetic unitary positive-working toner or negative-working toner and a magnetic binary positive-working toner or negative-working toner and developer. Accordingly, the arrangement of toner and OPC according to the combination of the present invention makes it possible to maintain desired image properties during continuous printing and hence invariably provide a good image.

The present invention will be described in greater detail below with referring to the following examples, but the invention should not be construed as being limited thereto.

EXAMPLE 1

Using an electrophotographic laser beam printer comprising OPC as an image carrier, printing was effected at a printing rate of 70 sheets per minute (printing process speed: 31 cm/sec), a charge potential of −800 V, a residual potential of −50 V, a development bias potential of −500 V and a development portion contrast potential of 450 V. In OPC, the charge-transporting layer consisted of two layers. The charge-transporting layer on the outer surface side had a charge-transporting agent concentration of 25% by weight and a thickness of 8 μm while the charge-transporting layer on the electrically conductive substrate side had a charge-transporting agent concentration of 45% by weight and a thickness of 20 μm.

As a toner there was prepared a negatively-charged non-magnetic toner having a volume-average particle diameter of 9 μm, a glass transition point of 60° C. and a softening point of 118° C. comprising a styrene-acryl copolymer as a binder in an amount of 88% by weight, a low molecular polypropylene (Viscole 330-P, produced by SANYO CHEMICAL INDUSTRIES, LTD.) in an amount of 3% by weight, a chrome-containing dye (Bontron S-34, produced by Orient Chemical Industries Limited) in an amount of 1% by weight and carbon black (#44, produced by Mitsubishi Chemical Corporation) in an amount of 8% by weight.

The toner had a hydrophobic silica (Aerosil R-972, produced by Nippon Aerosil Co., Ltd.) as a fluidizing agent and a magnetic powder (Type KBC-100 cubic magnetite, produced by KANTO DENKA KOGYO CO., LTD.; average particle diameter: 0.3 μm) as an electrically-conducting agent attached to the surface thereof in an amount of 0.3% by weight and 0.7% by weight, respectively.

As a carrier there was used a magnetite carrier (electrical resistivity: $2.0\times10^8$ Ω·cm) having an average particle diameter of 95 μm coated with a silicone resin containing an electrically-conducting agent. Thus, a developer having a toner concentration of 2.5% by weight was prepared. Using a magnetic brush, reversal development was effected with a development gap (distance between OPC and development roll sleeve) being 0.8 mm while OPC and the development roll were being moved in the same direction wherein the ratio of peripheral speed of the two members (development roll/OPC) was 3. The image thus formed was transferred to paper, and then fixed by a heat roll. The toner image left on OPC was removed by a blade cleaner.

Using the foregoing laser beam printer, continuous printing was effected over 300,000 pages or more. Thereafter, the change in the chargeability of the toner was examined. As a result, the initial chargeability of the toner was −15.7 μC/g as determined by suction Faraday process. After 300,000 pages of printing, the toner exhibited a chargeability of −16.5 μC/g. The change in image density between before and after the continuous printing was examined. As a result, the toner initially gave an image density of 1.40. After 300,000 pages of printing, the toner gave a good image having a density of 1.35 and little fog. Further, the fixability of the toner remained good even when the temperature of the heat roll in the fixing device was set to 180° C.

EXAMPLE 2

A toner having the same composition as in Example 1 was prepared except that as a binder there was used a partially-crosslinked polyester resin comprising as acid components trimellitic acid in an amount of 20 mol %, terephthalic acid in an amount of 20 mol % and hexadecenedicarboxylic acid in an amount of 10 mol % and as alcohol components a bisphenol A type propylene oxide adduct in an amount of 38 mol % and a bisphenol A type ethylene oxide adduct in an amount of 12 mol %. The same additives as used in Example 1 were then added to the toner to obtain a negatively-charged non-magnetic toner having a volume-average particle diameter of 8 μm, a glass transition point of 57° C. and a softening point of 110° C.

The toner thus obtained was then mixed with the same carrier as used in Example 1 to prepare a developer. Using the same laser beam printer as used in Example 1, continuous printing was then effected with this developer over 300,000 pages or more. The change in the chargeability of the toner was examined. As a result, the toner initially exhibited a chargeability of −16.3 μC/g as determined by suction Faraday process. After 300,000 pages of printing, the toner exhibited a chargeability of −18.5 μC/g. The change in image density between before and after the continuous printing was examined. As a result, the toner initially gave an image density of 1.35. After 300,000 pages of printing, the toner gave a good image having a density of 1.30 free of fog. Further, the fixability of the toner remained good even when the temperature of the heat roll in the fixing device was set to 170° C.

EXAMPLE 3

A toner having the same composition as in Example 1 was prepared except that as a binder there was used a polyester resin mixture containing 50% by weight of a polyester resin comprising as an acid component fumaric acid in an amount of 50 mol % and as an alcohol component a bisphenol A type propylene oxide adduct in an amount of 50 mol % and 50% by weight of a polyester resin comprising as acid components terephthalic acid in an amount of 35 mol % and isophthalic acid in an amount of 15 mol % and as alcohol components a bisphenol A type ethylene oxide adduct in an amount of 25 mol % and ethylene glycol in an amount of 25 mol %. The same additives as used in Example 1 were then added to the toner to obtain a negatively-charged non-magnetic toner having a volume-average particle diameter of 7.5 μm, a glass transition point of 60° C. and a softening point of 100° C.

The toner thus obtained was then mixed with the same carrier as used in Example 1 to prepare a developer. Using the same laser beam printer as used in Example 1, printing was then effected with this developer at a printing rate of 35 sheets per minute (printing process speed: 15.5 cm/sec). Continuous printing was effected over 300,000 pages or more. The change in the chargeability of the toner was then examined. As a result, the toner initially exhibited a chargeability of −16.2 μC/g as determined by suction Faraday process. After 300,000 pages of printing, the toner exhibited a chargeability of −17.5 μC/g. The change in image density between before and after the continuous printing was examined. As a result, the toner initially gave an image density of 1.35. After 300,000 pages of printing, the toner gave a good image having a density of 1.30 free of fog. Further, the fixing of the toner was effected by heating in an oven. Nevertheless, the fixability of the toner remained good even when the surface temperature of the printing paper was about 100° C.

As mentioned above, by arranging a developer comprising a particulate toner and a particulate carrier such that the volume-average particle diameter of the toner is from 6 μm to 10 μm and the weight-average particle diameter of the carrier is from 40 μm to 100 μm, a practical high precision developer can be obtained. If the average particle diameter of the toner falls below 6 μm, charging cannot be sufficiently controlled, causing the toner to be attached to the non-image area or scattered. On the contrary, if the average particle diameter of the toner exceeds 10 μm, the resulting image is rough and not fine.

On the other hand, if the average particle diameter of the carrier falls below 40 μm, it causes the carrier to be attached to the photoreceptor. On the contrary, if the average particle diameter of the carrier exceeds 100 μm, the resulting image is rough. If such a particulate toner/developer comprises an inorganic or organic particulate material as a fluidizing agent and a magnetic powder as an electrically conducting agent attached to the surface of the toner to exhibit an enhanced chargeability and is then used in combination with an organic photoreceptor comprising a charge-transporting layer consisting of a plurality of layers and hence having an enhanced surface durability and abrasion resistance, an electrostatic recording apparatus can be obtained which can provide invariably stabilized image having less quality deterioration even after repetition of printing on many sheets of printing paper.

In accordance with an embodiment of implication of the present invention, when a developer comprising a particulate toner having a volume-average particle diameter of from 6 μm to 10 μm and/or a particulate carrier having a weight-average particle diameter of from 40 μm to 100 μm is applied to an organic photoreceptor, the toner can keep its desired chargeability even after repeated printing over many sheets of paper and the photoreceptor can be abraded little, making it possible to prevent the reduction of image density and hence obtain less fogged stabilized images.

Further, as the toner binder there can be used a styrene resin, polyester resin, epoxy resin and/or resin obtained by graft copolymerization of polyester with styrene-acryl copolymer to predetermine the melt properties of the toner within the range of the present invention, making it possible to obtain a developer which can be fixed at low temperatures to give good image properties.

Figure 6:
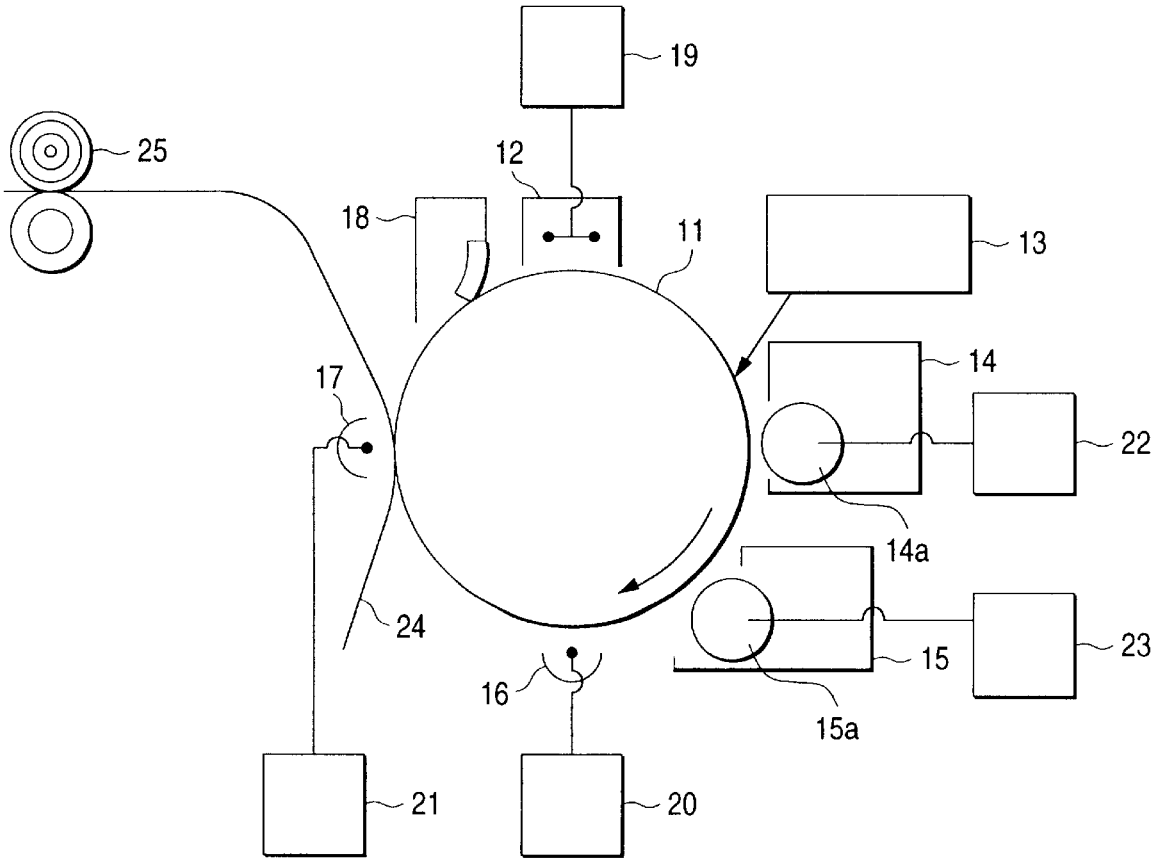
FIG. 6 is a schematic diagram illustrating an embodiment of the two-color electrophotographic apparatus according to the present invention.

FIG. 6 is a schematic diagram illustrating an embodiment of the electrostatic recording apparatus according to the present invention. This embodiment will be described hereinafter with reference to a two-color electrophotographic apparatus employing tristimulus value exposure process involving two-color printing using positively and negatively-charged toners.

In this drawing, a photoreceptor drum 11 rotates at a constant speed in the direction indicated by the arrow. Sequentially provided around the photoreceptor drum 11 are a charger 12, an optical device 13, a first developing unit 14, a second developing unit 15, a pre-transferring charger 16, a transferring device 17 and a cleaner 18.

The reference numerals 19, 20 and 21 indicate high voltage power supplies for applying high voltage to corotron wire in the charger 12, pre-transferring charger 16 and transferring device 17 to generate corona discharge, respectively. The reference numerals 22 and 23 indicate bias high voltage power supplies for applying bias voltage to the first developing unit 14 and second developing unit 15, respectively.

The operation of the foregoing two-color electrophotographic apparatus will be described hereinafter. The surface of the photoreceptor drum 11 is uniformly charged by the action of the charger 12, and then exposed to laser beam emitted by the optical device 13 to form an electrostatic latent image composed of three stages of voltage on the photoreceptor drum 11.

Among the three elements of the electrostatic latent image composed of three stages of voltage formed on the photoreceptor drum 11, the high potential portion VH (−900 V) is normally developed with a positively-charged toner having the polarity opposite to that of the photoreceptor drum 11 by the action of the first developing unit 14. In the present embodiment, the first developing unit 14 operates with a color toner other than black toner such as red toner. During this procedure, a bias voltage (−600 V) is applied to a development roller 14*a* in the first developing unit 14. No toner development is effected on the middle potential portion VM and the low potential portion VL.

Subsequently, the low potential portion VL (−50 V) is reverse-developed with a negatively-charged toner having the same polarity as that of the photoreceptor drum 11 by the action of the second developing unit 15. The second developing unit 15 operates with a black toner. During this procedure, a bias voltage (−300 V) is applied to a development roller 15*a* in the second developing unit 15. No toner development is effected on the middle potential portion VM and the high potential portion VH.

Subsequently, the toner is uniformly charged by the action of the pre-transferring charger 16. A charge having the polarity opposite to that of the toner is then given to the other side of paper 24 by the transferring device 17 to transfer the toner from the photoreceptor drum 11 to paper 24. The toner left untransferred on the photoreceptor drum 11 is then removed by the action of the cleaner 18. The toner thus transferred onto paper 24 is heated and compressed by the fixing device 25 so that it is fixed on paper 24. This process is then repeated to effect continuous printing.

In the two-color electrophotographic apparatus having the foregoing arrangement, the first developing unit 14 and the second developing unit 15 may operate with toners having different electrically conductive particulate materials incorporated therein. Developing machines which operate with color toners, which are more liable to color stain than black toner, preferably employ a toner comprising as an electrically conductive particulate material a white or transparent material such as tin oxide and indium oxide (containing tin) and as a fluidizing agent titanium oxide, aluminum oxide or the like to realize the representation of sharp color.

In accordance with the present invention, the attachment of an electrically conductive particulate material to the surface of a toner makes it possible to stabilize the chargeability of the toner. Accordingly, an electrostatic recording apparatus can be provided which can give stabilized images free from deterioration of image properties even after repetition of printing over many sheets of paper.

While the invention has been described in detail and with reference to specific embodiments thereof, it will be apparent to one skilled in the art that various changes and modifications can be made therein without departing from the spirit and scope thereof.

What is claimed is:

1. An electrostatic recording apparatus comprising:

an image carrier comprising an organic photoconductive photoreceptor having an abrasion-resisting outermost periphery;

an exposing unit which exposes said image carrier to form an electrostatic latent image thereon;

a developing unit which contains a developer and develops said electrostatic latent image with said developer to form a developed image, said developer comprising a toner and a carrier a transferring unit which transfers the developed image thus formed onto a recording medium;

and a fixing unit which fixes the transferred developed image on said recording medium, wherein said toner contained in said developing unit comprises and electrically conductive fine powder attached to the surface thereof, and said carrier has a weight-average particle diameter of from 40 $\mu$m to 100 $\mu$m.

2. The electrostatic recording apparatus according to claim 1, wherein said electrically conductive fine powder is at least one inorganic powder selected from the group consisting of magnetic powder, tin oxide powder and powder of indium oxide having tin incorporated therein.

3. The electrostatic recording apparatus according to claim 1, wherein said toner comprises a fluidizing agent attached to the surface thereof.

4. The electrostatic recording apparatus according to claim 1, wherein said organic photoreceptor comprises:

an electrically conductive substrate;

a charge-generating layer; and a charge-transporting layer comprising at least an outer surface side charge-transporting layer and an electrically conductive substrate side charge-transporting layer, wherein said outer surface side charge-transporting layer has a concentration of charge-transporting material which is smaller than that of said electrically conductive substrate side charge-transporting layer.

5. The electrostatic recording apparatus according to claim 1, wherein said organic photoreceptor comprises a charge-transporting layer comprising a plurality of layers including at least an outer side charge-transporting layer, wherein said outer surface side charge-transporting layer contains an organic or inorganic fine powder.

6. The electrostatic recording apparatus according to claim 1, wherein said developing unit comprises:

a first developing unit containing a color toner; and a second developing unit containing a black toner, wherein said color toner comprises a white or transparent electrically conductive fine powder attached to the surface thereof, and said black toner comprises a black electrically conductive fine powder attached to the surface thereof.

7. An electrostatic recording apparatus comprising:

an image carrier comprising an organic photoconductive photoreceptor having an abrasion-resisting outermost periphery;

an exposing means for forming an electrostatic latent image on said image carrier;

a developing means for developing said electrostatic latent image with a developer to form a developed image, said developer comprising a toner and a carrier;

a transferring means for transferring the developed image thus formed onto a recording medium; and a fixing means for fixing the transferred developed image on said recording medium, wherein said toner used in said developing means comprises an electrically conductive fine powder attached to the surface thereof, and said carrier has a weight-average particle diameter of from 40 $\mu$m to 100 $\mu$m.

8. The electrostatic recording apparatus according to claim 7, wherein said developing means comprises:

a first developing means for developing said electrostatic latent image with a color toner; and a second developing means for developing said electrostatic latent image with a black toner, wherein said color toner comprises a white or transparent electrically conductive fine powder attached to the surface thereof, and said black toner comprises a black electrically conductive fine powder attached to the surface thereof.

9. An electrostatic recording process comprising:

exposing an image carrier to form an electrostatic latent image thereon;

developing said electrostatic latent image with a developer to form a developed image, said developer comprising a toner and a carrier;

transferring the developed image thus formed onto a recording medium, and fixing the transferred developed image on said recording medium, wherein said image carrier comprises an organic photoconductive photoreceptor having an abrasion-resisting outermost periphery, and wherein said toner used in said development comprises an electrically conductive fine powder attached to the surface thereof, and said carrier has a weight-average particulate diameter of from 40 $\mu$m to 100 $\mu$m.

* * * * *